United States Patent [19]

Mathis, II

[11] Patent Number: 4,846,513

[45] Date of Patent: Jul. 11, 1989

[54] SLIDING TRUCK WINDOW BAR LOCK

[76] Inventor: George P. Mathis, II, 1916 5th St., Madison, Ill. 62060

[21] Appl. No.: 179,763

[22] Filed: Apr. 11, 1988

[51] Int. Cl.[4] ..... E05C 17/30

[52] U.S. Cl. ..... 292/262; 292/DIG. 46; 292/288; 292/5

[58] Field of Search ..... 292/259, 262, 302, DIG. 46, 292/288, 5; 403/108

[56] References Cited

U.S. PATENT DOCUMENTS

| | | | |
|---|---|---|---|
| 3,486,781 | 12/1969 | Crum | 292/262 |
| 3,651,786 | 3/1972 | Patterson et al. | 292/259 X |
| 3,806,178 | 4/1974 | Greytak | 292/218 |
| 3,825,290 | 7/1974 | Messina et al. | 292/262 |
| 3,855,946 | 12/1974 | Bales | 403/108 X |
| 3,927,906 | 12/1975 | Mieras | 292/262 |
| 3,993,336 | 11/1976 | Frost | 292/DIG. 46 |
| 4,302,038 | 11/1981 | Ervine | 292/263 |
| 4,349,223 | 9/1982 | Spector | 292/259 R |
| 4,493,501 | 1/1985 | Abel | 292/263 |
| 4,630,852 | 12/1986 | White et al. | 292/87 |

FOREIGN PATENT DOCUMENTS

| | | |
|---|---|---|
| 690792 | 7/1964 | Canada . |
| 1781476 | 9/1979 | Fed. Rep. of Germany . |

*Primary Examiner*—Richard E. Moore

*Attorney, Agent, or Firm*—Rogers, Howell & Haferkamp

[57] ABSTRACT

A sliding truck window bar lock includes a pair of bars, each bar being hingedly mounted atop a vertically oriented post and collar asembly and adapted for mounting to the rear wall of a passenger compartment in a pick-up truck such that an operator may move the bars into a locking orientation intermediate the edge of a sliding glass window and the window frame. Each bar may consist of a pair of telescoping tubes, each tube having a plurality of holes such that they may be telescoped in and out to align the holes and adjust the effective length thereof.

7 Claims, 1 Drawing Sheet

SLIDING TRUCK WINDOW BAR LOCK

BACKGROUND AND SUMMARY OF THE INVENTION

Many pick-up trucks sold in the United States today have a rear window in the cab behind the passengers' heads with one or two horizontally sliding glass windows. These windows may be opened to provide increased circulation of air through the passengers' compartment, or for other reasons while the vehicle is being operated. However, when the vehicle is parked and left overnight or for extended periods of time, it is necessary to lock these windows to prevent unauthorized entry therethrough and into the passengers' compartment. Otherwise, a prospective thief might easily reach through the windows, unlock the door locks, and gain access to the passengers' compartment.

Unfortunately, these sliding glass windows are typically provided with very flimsy locking arrangements which are easily defeated by anyone who is interested in gaining unauthorized access. This is perhaps for cost reasons as many of these windows are typically included in the relatively inexpensive, lightweight pick-up trucks presently being marketed by many of the major domestic and foreign manufacturers. Nevertheless, these windows provide a significant advantage over those pick-ups without windows and are highly desired by owners of these kinds of pick-up trucks. Therefore, many of these trucks are presently being manufactured and sold with these windows which provide very little resistance to unauthorized entry.

To solve these and other problems in the prior art, the inventor herein has succeeded in designing and developing a heavy-duty locking device for barring these windows in their closed position through the use of a pair of adjustable bars which can be retracted from behind the passengers' seat and moved easily in tandem up into position between the edge of the window and the frame. These bars are somewhat similar to the locking bar devices commonly used with sliding glass patio doors. However, the inventor herein has succeeded in designing and developing a mounting assembly which provides a convenient and unobtrusive mounting arrangement which is easily operable to bring both bars simultaneously into and out of their locking orientation. By utilizing the mounting assembly of the present invention, the bars may be retracted into a storage position substantially out of view between the truck seats and the rear wall of the passenger compartment or cab and yet with one hand, an operator may lift the locking bars from their stored position and conveniently place them into locking position with little attention paid to guiding their movement. Each bar may be hingedly mounted to the top of a vertically oriented post and collar assembly, the post sliding within the collar and having a detent to indicate to the operator when the proper vertical position has been achieved. At this point, the bars may then be swung rearwardly into position between the window edge and the frame. In a variation, the vertical detent may be eliminated and the bars may be allowed to rest in the track of the windows, the weight of the mounting assembly providing an increased security against their being moved out of position by a prospective thief.

Each bar can be sized in advance to fit a particular pick-up truck, or may be provided as a telescoping assembly of tubes with a plurality of holes along each tube to permit them to be telescoped into their desired length and then secured by a screw or the like inserted through at least two of the aligned holes in the tubes.

By utilizing the window bar locking device of the present invention, a pick-up truck owner may enjoy the advantages of being able to open his rear window to increase circulation of air through the cab without seriously detracting from the security of the cab. Because of the adjustable nature of the invention, and its relative ease in mounting, it is intended that this device can be sold in the after market to present owners of pick-up trucks. Additionally, its design may be conveniently adapted for use in new design pick-up trucks as they are manufactured and sold.

While the principal advantages and features of the present invention have been briefly discussed, a greater understanding of the invention can be attained by referring to the drawing and detailed description of the preferred embodiment which follows.

Detailed Description of the Preferred Embodiment

Figure 1:
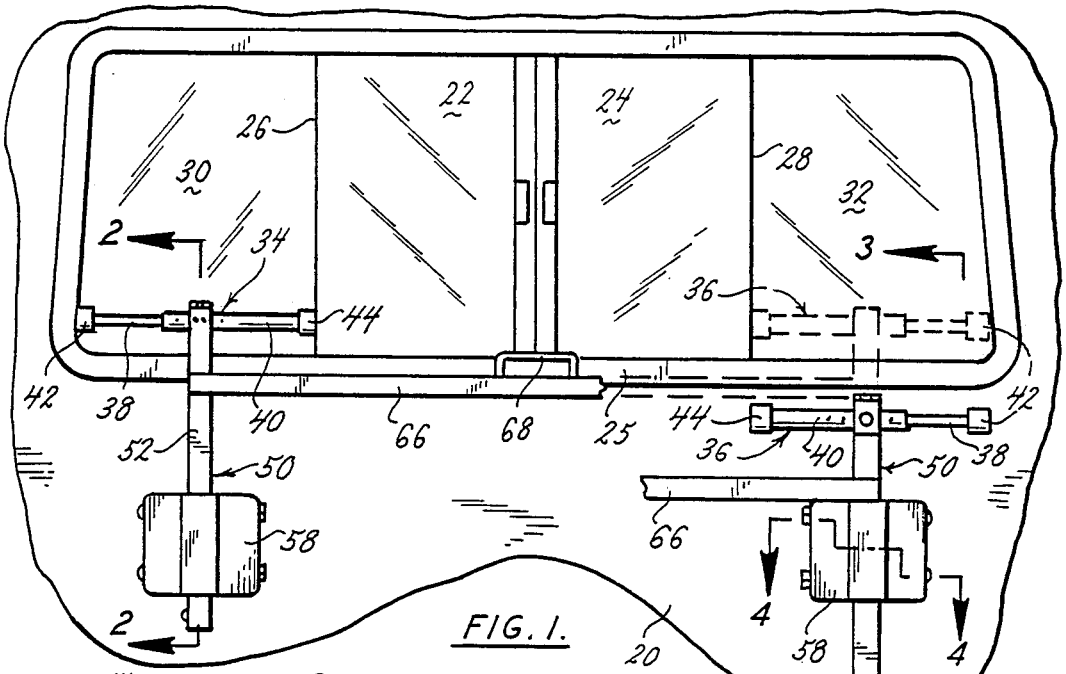
FIG. 1 is a partial view of the interior of a cab for a pick-up truck showing the dual sliding glass windows and the locking device of the present invention.

As shown in FIG. 1, the rear wall 20 of a pick-up truck cab or the like has a pair of sliding glass windows 22, 24 which are horizontally track mounted within a frame 25 so that they may be opened by sliding them horizontally away from the center line of the window. As each window 22, 24 rides in its own horizontal track, the outer edge 26, 28 of each overlaps a stationary window 30, 32 and is exposed to the interior of the cab.

Windows 22, 24 may be blocked into their closed position by moving a pair of blocking members 34, 36 into position between edges 26, 28 and the side of frame 25 to physically block them into their closed, abutting relationship as shown in FIG. 1 and prevent their sliding movement away from the center line of the window.

Figure 6:
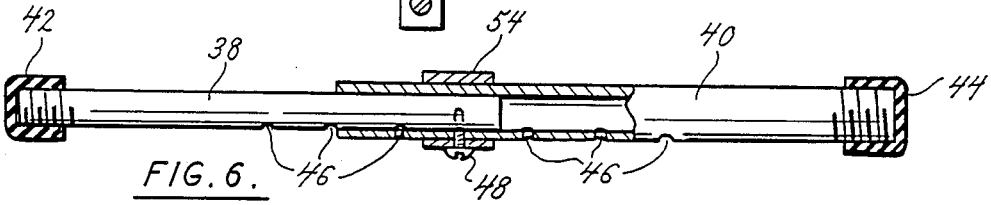
FIG. 6 is a partial cross-sectional view taken along the plane of line 6—6 in FIG. 2 detailing one of the blocking bar members.

Each blocking member 34, 36 is shown in FIG. 6 and includes a pair of telescoping tubes 38, 40 with protective rubber bumpers 42, 44 or the like to prevent damage to the window frame 25 or edges 26, 28. A plurality of holes 46 are drilled into each of the telescoping tubes 38, 40 and a screw 48 may be inserted through any pair of holes 46 to bring the blocking member 34, 36 into its proper length as desired for the particular size window.

Figure 2:
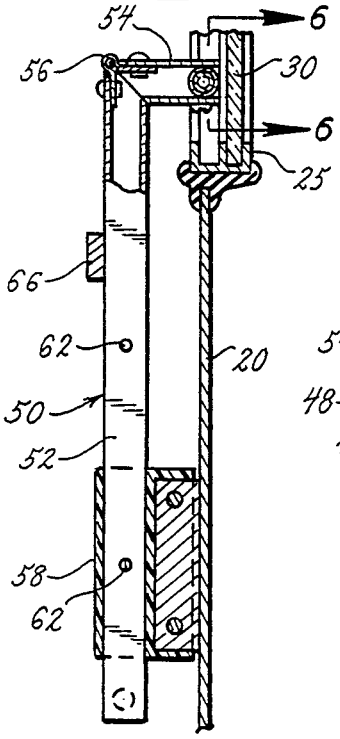
FIG. 2 is a partial cross-sectional view taken along the plane of line 2—2 in FIG. 1 detailing the sliding bar and mount for one side.
Figure 3:
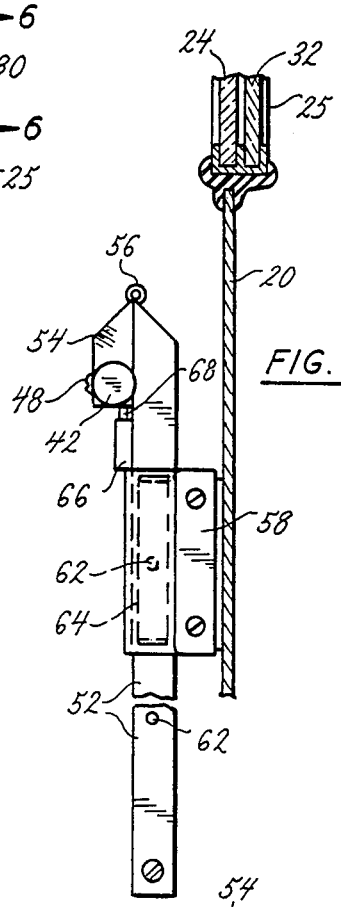
FIG. 3 is a side view of the invention shown in the non-blocking position.
Figure 4:
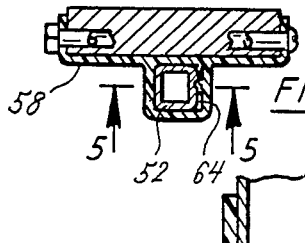
FIG. 4 is a partial cross-sectional view taken along the plane of line 4—4 in FIG. 1 detailing the post and collar assembly.
Figure 7:
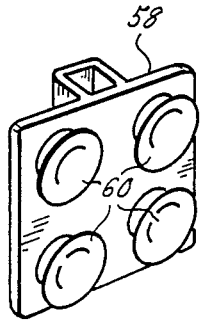
FIG. 7 is a perspective view of the collar member.
Figure 5:
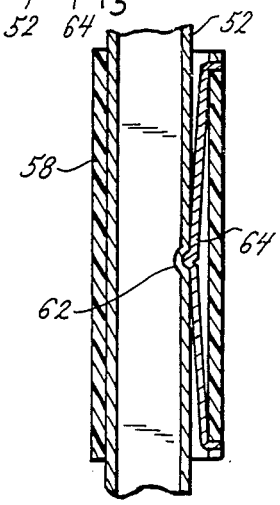
FIG. 5 is a partial cross-sectional view taken along the plane of line 5—5 in FIG. 4 detailing the detent.

As best shown in FIGS. 2–4, each blocking member 34, 36 is mounted to a post assembly 50 which includes a vertical member 52 and a blocking member carrier 54 which is hingedly mounted by hinge 56 to the top of vertical member 52. As shown in FIGS. 2 and 3, this permits the selective movement of the blocking member 34, 36 into and out of engagement with the window frame 25 and edges 26, 28. Each post assembly 50 is mounted within a collar member 58, collar member 58 being secured to the interior of the cab 20 by any suitable means, such as suction cups 60 as is shown in FIG. 7. Alternately, screws, bolt assemblies, or any other suitable means may be utilized to secure the present invention to the back wall of the interior of the cab, depending upon the operator's desires. The invention may be mounted either temporarily, so that it may be removed upon sale of the vehicle, or it may be permanently mounted. As best shown in FIG. 5, each vertical post member 52 may be provided with a dimple 62, and each collar assembly 58 may be provided with a spring 64 to create a detent to help the operator position the invention adjacent the windows for rotation of the blocking members 34, 36 into the window frame 25. With this detent formed by dimple 62 and spring 64, each post assembly 50 may be "detented" at both the extended and the retracted positions. To further facilitate simultaneous operation, a horizontal bar 66 with a handle 68 may be mounted and extend between the two vertical post members 52 of post assemblies 50 which serves to mechanically interlock them and permit their coordinated movement either up or down, as desired.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. A window bar assembly for mounting in a pick-up truck to permit an operator to bar the pair of sliding glass windows in the rear wall of the passenger compartment, the window bar assembly comprising a pair of bars, each of said bars being sized to extend substantially the entire distance between the edge of its associated window and the edge of the window frame, and a retractable mounting assembly having means to permit an operator to move said bars into and out of a locking orientation intermediate the edges of the windows and the frame whereby said windows are substantially prevented from sliding movement.

2. The device of claim 1 wherein the mounting assembly has means to permit simultaneous movement of the bars into and out of the locking orientation.

3. The device of claim 1 wherein the mounting asembly has means to permit movement of the bars into a stored position substantially between the seats and the rear wall of the passenger compartment.

4. The device of claim 1 further comprising means to adjust the effective length of each of said bars.

5. The device of claim 3 wherein the mounting assembly comprises a vertically oriented post and collar assembly associated with each bar, and detent means to hold the mounting assembly in its locking orientation.

6. The device of claim 3 wherein the mounting assembly has means to provide vertical and horizontal movement to the bars.

7. The device of claim 6 wherein the horizontal movement means comprises a hinge mounting each bar to the mounting assembly.

* * * * *